United States Patent [19]

Brannen et al.

[11] 4,435,301

[45] Mar. 6, 1984

[54] PREPARATION OF OVERBASED MAGNESIUM PHENATES

[75] Inventors: Cecil G. Brannen, Wayne Township, DuPage County; Mack W. Hunt, Naperville, both of Ill.

[73] Assignee: Standard Oil Company, (Indiana), Chicago, Ill.

[21] Appl. No.: 369,823

[22] Filed: Apr. 19, 1982

[51] Int. Cl.[3] ..... C10M 1/40

[52] U.S. Cl. ..... 252/33.2; 252/42.7; 252/389 R; 252/33.3; 252/18; 252/25

[58] Field of Search ..... 252/42.7, 33.2, 389 R, 252/18, 25

[56] References Cited

U.S. PATENT DOCUMENTS

| | | | |
|---|---|---|---|
| 3,629,109 | 12/1971 | Gergel et al. | 252/33.2 |
| 4,049,560 | 9/1977 | Dominey | 252/33.2 |
| 4,221,673 | 9/1980 | Robson et al. | 252/42.7 |

*Primary Examiner*—Jacqueline V. Howard

*Attorney, Agent, or Firm*—Richard A. Kretchmer; William T. McClain; William H. Magidson

[57] ABSTRACT

Overbased magnesium phenate compositions are prepared by reacting magnesium oxide in a diluent with: (1) a hydrocarbyl-substituted phenol and/or a sulfurized hydrocarbyl-substituted phenol, (2) an ammonium sulfonate, (3) a monohydric alcohol of from 1 to 4 carbon atoms and (4) water; removing the alcohol; and treating the resulting material with carbon dioxide.

12 Claims, No Drawings

PREPARATION OF OVERBASED MAGNESIUM PHENATES

BACKGROUND OF THE INVENTION

1. Field of the Invention

This invention relates to a method of preparing overbased magnesium phenates. More particularly, it relates to a process for preparing overbased magnesium phenates wherein magnesium oxide is used as the source of magnesium.

2. Description of the Prior Art

The operation of diesel and spark ignition internal combustion engines is typically accompanied by the formation of sludge, lacquer and resinous deposits which adhere to the moving engine parts and thereby reduce engine efficiency. In order to prevent or reduce the formation of these deposits, a wide variety of chemical additives have been developed for incorporation into lubricating oils. These additives, which are commonly referred to as detergents or dispersants, have the ability to keep deposit forming materials suspended in the oil so that the engine remains in a clean and efficient operating condition for extended periods of time. Among the many additives which have been developed for this purpose, the alkaline earth metal phenates and particularly their sulfurized derivatives have been found to be highly effective detergents for lubricating oils.

In addition to serving as highly efficient detergent additives for lubricating oils, alkaline earth metal phenates are also excellent oxidation and corrosion inhibitors. Further, these phenates have the ability to neutralize acidic combustion products which are formed during engine operation. The formation of these acidic products is a particular problem during engine operation with high sulfur fuels. These acids appear to cause degradation of the lubricating oil and are corrosive to metal engine components such as bearings. If uncontrolled, the corrosion induced by acidic combustion products can cause rapid engine wear and a resulting early engine breakdown.

To further improve the ability of alkaline earth metal phenate additives to neutralize acidic combustion products, these additives are commonly overbased.

The term "overbased" is used to describe phenates containing an amount of alkaline earth metal which is in excess of that required to react with the phenol from which the phenate is derived. In addition, this excess alkaline earth metal is present in a form which is capable of neutralizing acids. Typically, the excess metal is in the form of its carbonate, and the overbased phenate comprises a colloidal dispersion of the metal carbonate in the metal phenate as a dispersant.

Overbased calcium and barium sulfurized phenates have been widely used as additives for lubricating oil. Indeed, prior to about 1967, substantially all of the phenates used commercially in crankcase oils were overbased barium or calcium phenates. Although these overbased calcium and barium phenates neutralize acidic combustion products satisfactorily and are effective detergents, they do not provide a sufficient degree of rust inhibition for satisfactory protection of the engine parts. In contrast, the corresponding overbased magnesium phenates do provide the desired degree of rust inhibition. In addition, the overbased magnesium phenates are preferable over their calcium and barium counterparts because the magnesium containing compositions, as a consequence of the lower atomic weight of magnesium, afford a smaller quantity of inorganic ash for a given capacity to neutralize acid. Unfortunately, these magnesium phenates have been more expensive and far more difficult to prepare than their calcium and barium counterparts.

Many of the prior art processes for the preparation of overbased magnesium phenates involve the use of a magnesium alkoxide as a source of magnesium. Representative examples of this approach are set forth in U.S. Pat. Nos. 2,916,454 (Bradley et al.); 3,718,589 (Rogers et al.); 3,746,698 (Hunt et al.); 3,932,289 (King et al.); 4,104,180 (Burnop) and 4,196,089 (Pitzer et al.) and in British patent specification No. 2,055,886. However, such processes are unsatisfactory because they typically involve the use of magnesium metal, an expensive starting material, for the preparation of the magnesium alkoxides.

In view of its availability and low cost, magnesium oxide represents one of the most desirable sources of magnesium for use in the preparation of overbased magnesium phenates. However, as stated in the above mentioned U.S. Pat. No. 4,196,089 to Pitzer et al., efforts to produce overbased magnesium phenates having a total base number (TBN) in the range of about 200 to about 275 by reacting sulfurized oil-soluble aliphatic hydrocarbyl-substituted phenols with magnesium oxide combined with carbonation with carbon dioxide, even at quite high temperatures, have been unsuccessful.

The amount of alkaline material present in compositions such as overbased magnesium phenates is conventionally expressed in terms of a total base number (TBN). This is defined as the number of milligrams of potassium hydroxide which are equivalent to the amount of acid required to neutralize the alkaline material present in one gram of the composition. Consequently, the magnitude of the total base number serves to indicate the ability of a given composition to neutralize acids. A standard procedure for measuring TBN is set forth in American Society for Testing and Materials (ASTM) test D-2896.

U.S. Pat. No. 3,388,063 to Allphin discloses the preparation of highly overbased magnesium alkylphenates by a process which involves combining magnesium oxide, a dihydric alcohol, a relatively high molecular weight monohydric alcohol and a small amount of an alkaline earth metal sulfonate in a hydrocarbon medium, heating the mixture to drive off water and a major portion of the dihydric alcohol, adding a sulfurized alkylphenol at an elevated temperature, carbonating the composition with carbon dioxide and, finally, removing volatile materials. This process requires the use of a monohydric alcohol containing from 8 to 18 carbon atoms and a dihydric alcohol of from 2 to 3 carbon atoms. In addition, the process of this patent does not utilize water as a reactant.

U.S. Pat. No. 4,049,560 to Dominey discloses a process for the preparation of overbased magnesium phenates which involves the reaction of carbon dioxide with a mixture which comprises: (1) a sulfur-containing phenol such as a sulfurized phenol which contains one or more hydrocarbyl substituents; (2) a sulfonic acid, sulfonate or sulfate; (3) an alkanol such as methanol; (4) magnesium oxide or hydroxide; (5) a carboxylic acid, anhydride or salt; and (6) a diluent oil. However, the process of this patent does not involve removal of the alkanol prior to carbonation, does not utilize water as a reactant, but does require the use of a carboxylic acid, anhydride or salt as a promoter. Further, the products of this process have a relatively low total base number of about 200 to 250.

U.S. Pat. No. 4,137,186 to Sabol discloses a process for preparing overbased magnesium sulfonates which first involves forming a mixture which contains an oil-soluble ammonium sulfonate, a magnesium compound such as magnesium oxide, a lower alkanol such as methanol, and an inert diluent. This mixture is heated to hydrate the magnesium oxide, after which the lower alkanol is removed. Finally, the process is completed by addition of an acidic material such as carbon dioxide at a temperature between about 80° and 155° F. (27°–68° C.). This patent, however, contains no mention of a phenol, a sulfurized hydrocarbyl-substituted phenol or metal salt thereof and fails to suggest that a similar process could be utilized to prepare overbased magnesium phenates. U.S. Pat. No. 4,201,682 to Sabol et al. discloses a similar process for preparing overbased magnesium sulfonates but does not disclose the removal of the alkanol prior to carbonation with carbon dioxide.

SUMMARY OF THE INVENTION

The present invention is directed to the discovery of a process which permits the preparation of overbased magnesium phenate compositions of extremely high total base number through the use of magnesium oxide as the source of magnesium.

One embodiment of the invention is a process for the preparation of an overbased magnesium phenate composition which comprises: (a) reacting magnesium oxide in a substantially inert liquid diluent with: (i) at least one phenolic material selected from the group consisting of oil-soluble hydrocarbyl-substituted phenols and oil-soluble sulfurized hydrocarbyl-substituted phenols, (ii) an oil-soluble ammonium sulfonate, (iii) a monohydric alcohol of from 1 to 4 carbon atoms, and (iv) water, wherein the amount of magnesium oxide is in excess of the stoichiometric amount required for conversion of said sulfonate and phenolic material to neutral magnesium salts, and the ratio of equivalents of phenolic material to equivalents of ammonium sulfonate is from about 5 to about 30; (b) removing substantially all of said alcohol from the product of (a); and (c) contacting the product of (b) with carbon dioxide at a temperature in the range from about 0° to about 120° C.

An object of this invention is to provide a new process for the preparation of overbased magnesium phenates.

Another object of this invention is to provide an improved process for the preparation of overbased magnesium phenates from magnesium oxide.

Another object of this invention is to provide a process by which overbased magnesium phenates can be prepared which have a total base number in excess of 300.

Another object of this invention is to provide an inexpensive and simple process for the preparation of overbased magnesium phenates.

A further object of this invention is to provide a process for the preparation of gell-free overbased magnesium phenates which involves a single low temperature reaction with carbon dioxide.

A still further object of this invention is to provide an improved lubricating oil composition.

DETAILED DESCRIPTION OF THE INVENTION

We have found that overbased magnesium phenates prepared in accordance with this invention are gel-free and can be reproducibly prepared with extremely high total base numbers. The TBN of the overbased magnesium phenate products of this invention is desirably in excess of about 200, preferably in excess of about 250, and more preferably in excess of about 300.

In the practice of the present invention, magnesium oxide is reacted in a first step with: (1) a hydrocarbyl-substituted phenol and/or a sulfurized hydrocarbyl-substituted phenol; (2) an ammonium sulfonate; (3) a monohydric alcohol; and (4) water in a substantially inert liquid diluent. It will be appreciated, of course, that the precise manner in which these four starting materials are combined with magnesium oxide is not critical. For example, magnesium oxide and the other four starting materials can be combined in the diluent in any sequence. In a preferred embodiment, these four starting materials are simply mixed and reacted with magnesium oxide in the diluent. Another preferred embodiment involves combining the magnesium oxide, ammonium sulfonate and phenolic material in the diluent and adding the alcohol and water separately while the mixture is being heated.

The reaction of magnesium oxide with the phenolic compound or compounds, ammonium sulfonate, alcohol and water in accordance with this invention can be effected at temperatures in the range from about −10° to about 150° C., and preferably at a temperature in the range from about 20° to about 110° C. This temperature is not critical, however, and the reaction can conveniently be carried out at a reflux temperature.

Although the invention is not to be so limited, it is believed that the reaction of magnesium oxide involves several transformations. This reaction, of course, results in the conversion of the phenolic compound or compounds to the corresponding magnesium salt or salts. In addition, it is believed that the magnesium oxide undergoes hydration to produce a hydrated magnesium hydroxide. Finally, the ammonium sulfonate is converted to the corresponding magnesium sulfonate with the evolution of ammonia. Once liberated, this ammonia appears to promote hydration of the magnesium oxide. However, the method by which this ammonia acts to increase the reactivity of the magnesium oxide toward hydration is not understood.

The phenolic compound or compounds and ammonium sulfonate are used in amounts such that the ratio of equivalents of phenolic material to equivalents of ammonium sulfonate is from about 5 to about 30. Typically, the amount of ammonium sulfonate will be quite small. However, it is not ordinarily possible to prepare an overbased magnesium phenate product having a high TBN if the amount of ammonium sulfonate in the initial hydration stage of the process is less than about 2 percent by weight based on the total composition.

At the end of the initial hydration step, the alcohol must be removed from the reaction mixture. The alcohol can be removed by conventional techniques, for example, by distillation. However, any alcohol which is coordinated or chemically bound to the magnesium compounds must be displaced by water. Since a substantially complete removal of alcohol is necessary, a first stripping of alcohol followed by water addition and a second stripping may be required to fully effect a removal of the alcohol. Indeed, water addition followed by stripping of alcohol can be repeated as many times as necessary to effect a substantially complete removal of the alcohol. If desired, a stream of inert gas, such as nitrogen, can be passed through the heated mixture to facilitate removal of the alcohol.

After removal of the alcohol, the mixture is treated with carbon dioxide at a temperature in the range from about 0° to about 120° C., and preferably from about 25° to about 70° C. Although the invention is not to be so limited, it is believed that any residual alcohol which is not removed serves to inhibit the carbonation. To insure complete carbonation of the mixture, treatment with carbon dioxide is ordinarily continued until gas absorption essentially stops. If desired, additional water can be added during the treatment with carbon dioxide. This water can either be added continuously or in increments during the carbonation. The amount of additional water can vary over a wide range, but is typically from about 0.5 to about 3 moles per mole of magnesium oxide starting material.

Water is required in the subject process during both the hydration and carbonation steps. Generally, about 1 to about 8 moles of water per mole of magnesium oxide starting material are used.

Although the invention is not to be so limited, it is believed that two distinct chemical processes are involved in the overbasing process. More specifically, it is believed that the magnesium oxide is initially converted to a hydrated magnesium hydroxide in the initial hydration step as described above. It is further believed that this hydrated magnesium hydroxide then reacts with carbon dioxide during the carbonation step to produce a hydrated complex salt of magnesium carbonate and magnesium hydroxide.

Upon completion of the carbonation step, any suspended solids can be removed from the overbased product by conventional techniques such as filtration or centrifugation. Volatile materials such as organic solvents can be removed by distillation or by passing a stream of inert gas through the product at an elevated temperature. For example, volatiles can be removed by blowing the material with nitrogen or carbon dioxide at a temperature of about 180° C. The magnesium concentration of the product can range from about 0.5 to about 12 percent by weight, and is preferably from about 4 to about 11 percent by weight.

Any type of magnesium oxide can be used in the practice of this invention. Although it is advantageous to utilize high purity and highly active magnesium oxide, technical or lower grades of material can be satisfactorily used. The amount of magnesium oxide used in the process of this invention is in excess of the stoichiometric amount required for conversion of the phenolic compound or compounds and the ammonium sulfonate to neutral magnesium salts. Ordinarily, the amount of magnesium oxide will be from about 1.5 to about 30, and preferably from about 3 to about 10 equivalents per equivalent of phenolic compound and ammonium sulfonate.

The substantially inert liquid diluent is ordinarily used in an amount within the range from about 20 to about 80 percent by weight of the reaction mixture. Suitable diluents include but are not limited to lubricating oils and also other aliphatic, alicyclic and aromatic hydrocarbons. Suitable lubricating oils include mineral oil; synthetic materials such as olefin polymers, polyoxypropylene and dicarboxylic acid esters; vegetable oils such as cottonseed oil, corn oil and castor oil; and animal oils such as lard oil and sperm oil. Preferably, however, a mixture of mineral oil with an aromatic hydrocarbon solvent such as xylene or toluene is used in the process of this invention. A mixture of mineral oil and xylene is a particularly preferred diluent since the boiling point of this combination is such that the alcohol can usually be removed from the reaction mixture by simple distillation while the bulk of the xylene remains in the mixture. The xylene is used to provide control over the viscosity of the mixture.

A monohydric alcohol of from 1 to 4 carbon atoms is used in the initial hydration step of the process. Alcohols which are useful in the present invention include methanol, ethanol, 1-propanol, 2-propanol, 1-butanol, 2-butanol, 2-methyl-1-propanol, and 2-methyl-2-propanol. However, methanol is highly preferred because of its low cost and effectiveness in the subject process. Generally, from about 0.1 to about 5 moles of alcohol can be used per mole of magnesium oxide.

The oil-soluble hydrocarbyl-substituted phenols which are suitable for use in the practice of this invention have the formula:

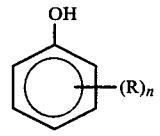

wherein R is a hydrocarbyl or substituted hydrocarbyl group containing up to 60 carbon atoms and n is an integer having a value from 1 to 4. Preferably, R is a straight or branched chain, saturated or unsaturated aliphatic group having from 6 to 30 carbon atoms and n is an integer from 1 to 3. More preferably, R is an alkyl group of from 6 to 30 carbon atoms and n is an integer of 1 or 2. Specific examples of suitable R groups include alkyl groups such as hexyl, octyl, ethylhexyl, nonyl, decyl, dodecyl, hexadecyl, eicosyl, hexacosyl, and triacontyl as well as groups derived from hydrocarbons, such as white oil wax, and olefin polymers, such as polypropylene and polybutylene.

As used herein, the term hydrocarbyl is used to designate a monovalent organic group composed of hydrogen and carbon. It can be aliphatic, aromatic, alicyclic or combinations thereof and includes, but is not limited to, alkyl, cycloalkyl, cycloalkylalkyl, aralkyl, alkenyl and alkynyl.

In a highly preferred embodiment of the invention, the oil-soluble hydrocarbyl-substituted phenol is sulfurized. These sulfurized compounds are preferred because their use results in a product which has an improved ability to inhibit oxidation and corrosion. The sulfurized hydrocarbyl-substituted phenols can be prepared by reaction of the above described hydrocarbyl-substituted phenols with a sulfur-yielding material such as sulfur monochloride, sulfur dichloride and elemental sulfur. The preparation of sulfurized hydrocarbyl-substituted phenols is well known in the art and is described, for example, in U.S. Pat. Nos. 2,409,687 (Rogers et al.), 2,916,454 (Bradley et al.), 3,509,053 (Branch), 3,801,507 (Hendrickson et al.), and 4,104,180 (Burnop). These patents are hereby incorporated by reference herein. Irrespective of the precise manner in which they are prepared, the sulfurized hydrocarbyl-substituted phenols which are useful in the practice of this invention suitably contain from about 0.5 to about 20 weight percent sulfur, and preferably from about 4 to about 15 weight percent sulfur.

The ammonium sulfonates which are suitable for use in the practice of this invention are derived from hydrocarbyl sulfonic acids which have an equivalent weight in the range from about 250 to about 2,000. In more detail, these sulfonic acids can be represented by formulas I and II:

$$(R^1)_x—Ar—(SO_3H)_y \quad \text{I}$$

$$R^2—(SO_3H)_z \quad \text{II}$$

In formula I, Ar is a cyclic organic nucleus of the mono- or polynuclear type, including benzenoid or heterocyclic nuclei such as that of benzene, naphthalene, anthracene, 1,2,3,4-tetrahydronaphthalene, thianthrene or biphenyl and the like. Preferably, however, Ar is an aromatic hydrocarbon nucleus, especially a benzene or naphthalene nucleus. $R^1$ is an aliphatic or substituted aliphatic group, examples of which include alkyl, alkenyl, alkoxy, alkoxyalkyl, carboalkoxyalkyl, and aralkyl groups. Both x and y are independently an integer which is at least 1, with the proviso that the variables represented by $(R^1)_x$ are such that the acid and its ammonium salt are oil-soluble. This means that the groups represented by $(R^1)_x$ should provide at least about eight aliphatic carbon atoms per molecule of sulfonic acid, and preferably at least about twelve aliphatic carbon atoms. Preferably, x and y are integers of from 1 to 3. Finally, the $R^1$ and Ar groups in formula I can carry substituents such as hydroxy, mercapto, halogen, amino, carboxy, lower carboalkoxy, and the like so long as the essentially hydrocarbon character of the groups is not destroyed.

In formula II, $R^2$ is an aliphatic, substituted aliphatic, alicyclic, or substituted alicyclic group which desirably contains a total of at least about 12 carbon atoms. Examples of suitable $R^2$ groups include alkyl, alkenyl, and alkoxyalkyl groups and also substituted alicyclic groups wherein the substituents are alkoxy, alkoxyalkyl, and carboalkoxyalkyl. Generally, the alicyclic group is a cycloalkane nucleus such as cyclopentane, cyclohexane, cyclohexene, and the like. Specific examples of $R^2$ include cetylcyclohexyl, laurylcyclohexyl, ethoxycetyl and octadecenyl as well as groups derived from paraffin waxes and polyolefins, including polymerized mono- and diolefins containing from about 1 to 8 carbon atoms per olefin monomer unit. The $R^2$ group in formula II can carry substituents such as hydroxy, mercapto, halogen, amino, carboxy, carboalkoxy and the like so long as the essentially hydrocarbon character of the group is not destroyed. Finally, z in formula II is an integer of from 1 to 3.

Illustrative examples of suitable sulfonic acids include mahogany sulfonic acids, petrolatum sulfonic acids, mono- and polywax-substituted naphthalene sulfonic acids, polyolefin-substituted benzene sulfonic acids, cetylchlorobenzene sulfonic acids, cetylphenol sulfonic acids, cetylphenol disulfide sulfonic acids, dilauryl-beta-naphthol sulfonic acids, paraffin wax sulfonic acids, petroleum naphthene sulfonic acids, laurylcyclohexyl sulfonic acids, mono-and polywax-substituted cyclohexyl sulfonic acids and the like.

Sulfonic acids derived from hard and soft detergent alkylate bottoms are advantageous in that these acids are commercially available. Both hard and soft detergent alkylate bottoms are alkyl benzenes. The hard material comprises alkyl benzenes in which the alkyl groups are highly branched. In contrast, the soft material comprises alkyl benzenes wherein the alkyl groups are less branched and more nearly straight chain in character. Sulfonic acids derived from hard detergent alkylate bottoms are preferred over the sulfonic acids derived from the soft alkylate bottoms because the branched alkyl groups result in a greater oil solubility and a correspondingly lower water solubility.

The ammonium sulfonate which is required for the practice of this invention can be obtained by neutralization of the sulfonic acid with ammonia gas or with ammonium hydroxide. It will be appreciated, of course, that the sulfonic acid can be at any convenient temperature and in a suitable solvent or neat during the neutralization.

The overbased magnesium phenate compositions prepared in accordance with this invention can be incorporated into a lubricating oil by simple mixing. Suitable lubricating oils include, for example, oils of the type which are also suitable for use as a diluent during the preparation of the subject magnesium phenate compositions. A lubricating oil composition will typically comprise a major portion of a lubricating oil in combination with the overbased magnesium phenate, wherein the amount of overbased magnesium phenate is from about 0.01 to about 40 weight percent and, preferably, from about 0.1 to about 15 weight percent of the lubricating oil composition.

The overbased magnesium phenate compositions of this invention can be used in combination with other conventional lubricating oil additives which include, but are not limited to, extreme pressure agents, friction modifiers, viscosity index improvers, antioxidants, dispersants, and pour point depressants.

The following examples are intended only to illustrate the invention and are not to be construed as imposing limitations on it.

EXAMPLE I

A mixture of 262 grams (1.0 mole) of dodecylphenol, 64 grams (2.0 moles) of elemental sulfur, and 4 grams of a 50% aqueous solution of sodium hydroxide (0.05 mole of NaOH) was heated at 232° C. for 3 hours. The resulting sulfurized dodecylphenol contained 9.3% sulfur and 31.9% unreacted dodecylphenol.

EXAMPLE II

Example I was repeated except that the reaction mixture additionally contained 2.5 grams of water and the heating was at 204° C. for 6.5 hours. The resulting sulfurized dodecylphenol contained 14.9% sulfur.

EXAMPLE III

A mixture of 262 grams (1.0 mole) of dodecylphenol, 32 grams (1.0 mole) of elemental sulfur, 31 grams of ethylene glycol, 4 grams of a 50% aqueous solution of sodium hydroxide (0.05 mole of NaOH), and 2.5 grams of water was heated at 204° C. for 2 hours and 20 minutes. After the addition of an additional 16 grams of sulfur, heating was continued at 204° C. for another 75 minutes. Finally, another 16 grams of sulfur were added and heating continued at 204° C. for 25 minutes. The resulting sulfurized dodecylphenol contained 13.2% sulfur.

EXAMPLE IV

A mixture of 262 grams (1.0 mole) of dodecylphenol, 32 grams (1.0 mole) of elemental sulfur, and 4 grams of a 50% aqueous solution of sodium hydroxide (0.05 mole of NaOH) was heated at 232° C. for 5.5 hours. The resulting sulfurized dodecylphenol contained about 4.3% sulfur and 58.4% unreacted dodecylphenol.

EXAMPLE V

To a 2-liter 3-neck round bottom flask fitted with a heating mantle, reflux condenser, stirrer and dropping funnel was added 80 grams of sulfurized dodecylphenol from Example I, 30 grams of an ammonium sulfonate composition (containing 55.7% of the ammonium salt of a polypropylene-substituted benzenesulfonic acid having an equivalent weight of 641, 5% volatiles, 1.72% sulfate and 37.6% 5W oil), 26 grams of solvent extracted 5W oil, 300 grams of xylene, and 35 grams of magnesium oxide. The mixture was then heated, and 14.5 grams of methanol were added when its temperature reached 38° C. and 23 grams of water were added when its temperature reached 60° C. Heating was continued and the resulting mixture heated at reflux (about 81° C.) for 2 hours. A Dean Stark water trap was placed between the reaction flask and the reflux condenser and methanol was removed with the trap by: (1) heating the mixture to 92° C.; (2) adding 10.0 grams of water and heating the mixture to 96° C.; and (3) adding 4.5 grams of water and heating the mixture to 104° C. Heating was then discontinued and 120 milliliters of xylene were added. After cooling to 38° C., 12 milliliters of water were added and the mixture then treated with gaseous carbon dioxide which was introduced below the surface of the reaction mixture at a rate of 0.35 liter/minute over a period of 1 hour, while the reaction mixture was maintained at a temperature of 38°–46° C. A total of 13.2 liters of carbon dioxide were absorbed by the reaction mixture. The mixture was then heated to 121° C. to remove water by way of the Dean Stark water trap. Next, 600 milliliters of xylene were added and the resulting mixture vacuum filtered through a thin layer of celite. Finally, xylene was removed from the product by heating to 177° C. while passing a very slow stream of carbon dioxide through the material. The resulting product had a TBN of 386, a viscosity at 99° C. of 820 Saybolt Universal seconds (SUS), and contained 3.71% sulfur, 8.1% magnesium and 87 ppm of sodium.

EXAMPLE VI

Example V was repeated except that the amount of magnesium oxide was only 27 grams. A total of 9.1 liters of carbon dioxide was absorbed by the reaction mixture during carbonation. The resulting product had a TBN of 289 and a viscosity at 99° C. of 194 SUS.

EXAMPLE VII

Example V was repeated except that the amount of magnesium oxide was increased to 45 grams. A total of 12.6 liters of carbon dioxide was absorbed by the reaction mixture during carbonation. The resulting product had a TBN of 314.

EXAMPLE VIII

Example V was repeated except that 80 grams of the sulfurized dodecylphenol of Example II were used and the amount of magnesium oxide was only 24 grams. A total of 9.7 liters of carbon dioxide was absorbed by the reaction mixture during carbonation. The resulting product had a TBN of 265, a viscosity at 99° C. of 91 SUS, and contained 7.0% sulfur.

EXAMPLE IX

Example V was repeated except that 90 grams of the sulfurized dodecylphenol of Example III were used and the amount of magnesium oxide was only 24 grams. A total of 10.4 liters of carbon dioxide was absorbed by the reaction mixture during carbonation. The resulting product had a TBN of 263, a viscosity at 99° C. of 245 SUS, and contained 7.0% sulfur.

EXAMPLE X

Example V was repeated except that 80 grams of the sulfurized dodecylphenol of Example IV were used and the amount of magnesium oxide was only 27 grams. A total of 11.7 liters of carbon dioxide was absorbed by the reaction mixture during carbonation. The resulting product had a TBN of 303 and a viscosity at 99° C. of 112 SUS.

We claim:

1. A process for the preparation of an overbased magnesium phenate composition which comprises:

(a) reacting magnesium oxide in a substantially inert liquid diluent with: (i) at least one phenolic material selected from the group consisting of oil-soluble hydrocarbyl-substituted phenols and oil-soluble sulfurized hydrocarbyl-substituted phenols, (ii) an oil-soluble ammonium sulfonate, (iii) a monohydric alcohol of from 1 to 4 carbon atoms, and (iv) water, wherein the amount of magnesium oxide is in excess of the stoichiometric amount required for conversion of said sulfonate and phenolic material to neutral magnesium salts, and the ratio of equivalents of phenolic material to equivalents of ammonium sulfonate is from about 5 to about 30;

(b) removing substantially all of said alcohol from the product of (a); and (c) contacting the product of (b) with carbon dioxide at a temperature in the range from about 0° to about 120° C.

2. The process as set forth in claim 1 wherein said phenolic material comprises an oil-soluble sulfurized hydrocarbyl-substituted phenol.

3. The process as set forth in claim 1 wherein said phenolic material comprises an oil-soluble sulfurized alkyl-substituted phenol wherein the alkyl group contains from 6 to 30 carbon atoms.

4. The process as set forth in claims 1, 2 or 3 wherein said diluent is hydrocarbon in character.

5. The process as set forth in claim 4 wherein said diluent comprises a mixture of lubricating oil and aromatic solvent.

6. The process as set forth in claim 5 wherein said aromatic solvent comprises xylene.

7. The process as set forth in claims 4, 5 or 6 wherein said monohydric alcohol is methanol.

8. The process as set forth in claim 1 wherein said ammonium sulfonate is the ammonium salt of a hydrocarbyl sulfonic acid having an equivalent weight in the range from about 250 to about 2,000.

9. The process as set forth in claim 1 wherein the amount of ammonium sulfonate is at least about 2 percent by weight based on the total composition in step (a).

10. The process as set forth in claim 1 wherein the amount of water is from about 1 to about 8 moles per mole of magnesium oxide.

11. The process as set forth in claim 1 wherein the amount of said monohydric alcohol is from about 0.1 to about 5 moles per mole of magnesium oxide.

12. The process as set forth in claim 1 wherein volatile material is removed at a temperature up to about 180° C. upon completion of step (c).

* * * * *